US006855918B2

(12) United States Patent
Do

(10) Patent No.: US 6,855,918 B2
(45) Date of Patent: Feb. 15, 2005

(54) MICROWAVE OVEN AND METHOD OF CONTROLLING THE SAME UPON RECOGNIZING POWER SUPPLY FREQUENCY

(75) Inventor: Joo-Hyun Do, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 85 days.

(21) Appl. No.: 10/354,104

(22) Filed: Jan. 30, 2003

(65) Prior Publication Data

US 2004/0069777 A1 Apr. 15, 2004

(30) Foreign Application Priority Data

Oct. 10, 2002 (KR) ..... 10-2002-0061665

(51) Int. Cl.[7] ..... H05B 6/68
(52) U.S. Cl. ..... 219/718; 219/721; 219/702
(58) Field of Search ..... 219/715, 718, 219/702, 720, 716, 719, 721

(56) References Cited

U.S. PATENT DOCUMENTS 4,855,648 A * 8/1989 Yagasaki ..... 315/307
4,939,333 A * 7/1990 Sakai et al. ..... 219/719
6,138,232 A 10/2000 Shiell et al.
2002/0179597 A1 * 12/2002 Kitaizumi et al. ..... 219/715

FOREIGN PATENT DOCUMENTS

JP 5346445 12/1993

* cited by examiner

*Primary Examiner*—Teresa J. Walberg
(74) *Attorney, Agent, or Firm*—Staas & Halsey LLP

(57) ABSTRACT

A microwave oven and a method of controlling the microwave oven recognize a power supply frequency correctly at a time power is supplied by eliminating the influence of noise. A blocking period is set in which generation of interrupts is deferred until a timer count reaches a predetermined set value, and interrupts are generated if the blocking period elapses. Accordingly, the microwave oven and method of the controlling the microwave oven recognize a power supply frequency without the influence of noise at the time of the power supply, thereby improving reliability of the microwave oven.

25 Claims, 6 Drawing Sheets

MICROWAVE OVEN AND METHOD OF CONTROLLING THE SAME UPON RECOGNIZING POWER SUPPLY FREQUENCY

CROSS-REFERENCE TO RELATED APPLICATION

This application claims the benefit of Korean Application No. 2002-61665, filed Oct. 10, 2002, in the Korean Intellectual Property Office, the disclosure of which is incorporated herein by reference.

BACKGROUND OF THE INVENTION

1. Field of the Invention

The present invention relates generally to a microwave oven and method of controlling the same, and more particularly, to a microwave oven and a method of controlling the microwave oven to recognize a power supply frequency correctly at the time of power supply by eliminating the influence of noise.

2. Description of the Related Art

In general, a microwave oven is an apparatus for heating and cooking food using microwaves, which includes various drive devices, such as a high voltage transformer, a magnetron and the like, and is supplied with power from the outside to operate the drive devices. The microwave oven generates external interrupts corresponding to a power supply frequency and calculates cooking time using these interrupts. Since the power supply frequency is different depending on the installation environment of the microwave oven, for example, 50 Hz or 60 Hz, the microwave oven must correctly recognize the power supply frequency supplied.

When the power code of the microwave oven is applied to a power supply outlet, the power supply becomes unstable due to the defective application of the power code to the outlet, signal delay or the like. Thus, it is difficult to correctly measure the power supply frequency.

In consideration of this problem, in the conventional microwave oven, a power supply frequency is measured when a certain time elapses after the power has been supplied. As shown in FIG. 1, when external interrupts corresponding to a certain frequency are input, the measurement of the power supply frequency is deferred during a first period for which a power supply signal of twenty cycles is input. Thus, after the first period has elapsed, the power supply frequency is measured during the next 20 cycles of the second period. Since the power supply signal includes delay signals E1 and E2, the power supply frequency can be recognized incorrectly due to the delay signals E1 and E2. Hence, the power supply frequency needs to be measured a plurality of times, for example, twenty times.

FIG. 2 is a flowchart illustrating a conventional method of controlling the microwave oven. When power is supplied to the microwave oven by applying the power code to the outlet, an inner timer is operated and a timer count B is increased at operations 70 and 72, respectively. Thereafter, it is determined whether external interrupts are generated at operation 74. If the external interrupts are generated, the first number of times A the external interrupts are generated is increased cumulatively at operation 76.

Thereafter, it is determined if the accumulated first number of times A exceeds twenty at operation 78. If the first number of times A is less than twenty, the timer count B is cleared at operation 79 and proceeds to operation 70 to accumulate the first number of times A continuously. If the first number of times A exceeds twenty, that is, if the first period for which the power supply frequency is not measured elapses, it is determined whether the timer count B reaches a set value, for example, fifteen, that discriminates between a first power supply frequency of 50 Hz and a second power supply frequency of 60 Hz at operation 80. If the timer count B reaches fifteen, a second number of times C is accumulatively increased at operation 82. Thereafter, it is determined if the first number of times A equals forty at operation 84. If the timer count B is less than fifteen, the process proceeds to operation 84.

As the result of the determination at operation 84, if the first number of times A is less than forty, the process proceeds to operation 79 where the timer count B is cleared, and then proceeds to operation 70. As the result of the determination at operation 84, if the first number of times A equals forty, that is, if the second period elapses, it is determined if the second number of times C is equal to or larger than ten at operation 86. If the second number of times C is equal to or larger than ten, the power supply frequency is set to a first frequency of 50 Hz at operation 88. In contrast, if the second number of times C is smaller than ten, the power supply frequency is set to a second frequency of 60 Hz at operation 90.

However, the conventional microwave oven is problematic in that the conventional microwave oven is affected significantly by high frequency noise at the time power is supplied. When an external interrupt includes high frequency noise as shown in FIG. 3, five or six extraneous external interrupts are generated even though only one external interrupt is actually generated. For this reason, the first period for which the measurement of the power supply frequency is deferred is shortened, and the power supply frequency is measured in a state of unstable power. For example, in the case where the power supply frequency of 50 Hz, including high frequency noise, is measured, the timer count B is cleared before the timer count B reaches fifteen, and the second number of times C is less than ten, so the power supply frequency is determined to be 60 Hz. Accordingly, the power supply frequency may be recognized incorrectly.

In consideration of the above-described problems, a method employing a low pass filter may be used in the microwave oven to eliminate high frequency noise. However, this conventional method is disadvantageous because the manufacturing cost of a microwave oven is increased by adding an expensive part thereto.

SUMMARY OF THE INVENTION

Accordingly, it is an aspect of the present invention to provide a microwave oven and method of controlling the microwave oven, which recognizes a power supply frequency correctly at the time of power supply by eliminating the influence of noise.

Additional aspects and advantages of the invention will be set forth in part in the description which follows and, in part, will be obvious from the description, or may be learned by practice of the invention.

The foregoing and/or other aspects of the present invention are achieved by providing a microwave oven including a power supply unit; an interrupt generation unit generating interrupts corresponding to a power supply frequency of the power supply unit; and a control unit setting a blocking period to block generation of the interrupts and recognizing the power supply frequency on the basis of the interrupts generated by the interrupt generation unit when the blocking period elapses.

The foregoing and/or other aspects of the present invention are achieved by providing a method of controlling a microwave oven including setting a blocking period to block generation of interrupts by the power supply frequency, increasing a timer count using a inner timer, determining whether the blocking period has elapsed by comparing the timer count with a set value, generating interrupts corresponding to the power supply frequency if the blocking period has elapsed, and determining the power supply frequency according to the generated interrupts.

The foregoing and/or other aspects of the present invention are achieved by providing a method of controlling a microwave oven including setting a first period for which measurement of the power supply frequency is deferred and a second period for which the measurement of the power supply frequency is carried out and setting a blocking period in which generation of interrupts is blocked for each cycle period of a power supply signal with the power supply frequency in the first period or the second period.

BRIEF DESCRIPTION OF THE DRAWINGS

These and other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
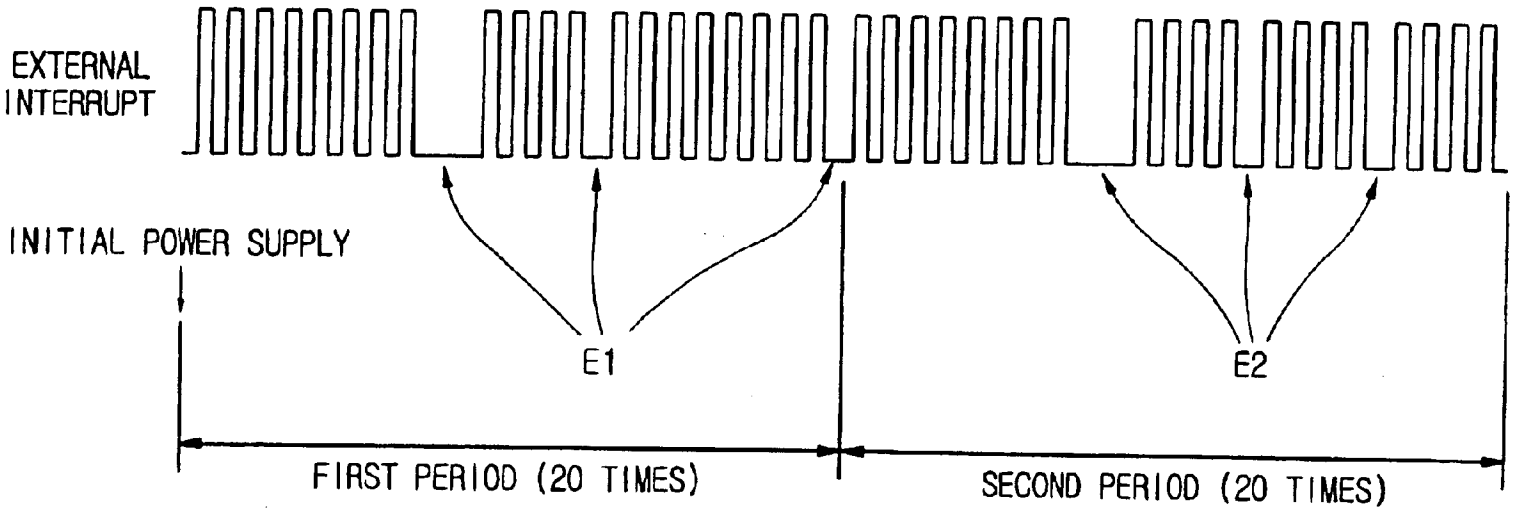
FIG. 1 (PRIOR ART)
FIG. 1 is a schematic view illustrating the conventional operation of measuring a power supply frequency in a microwave oven.
Figure 2:
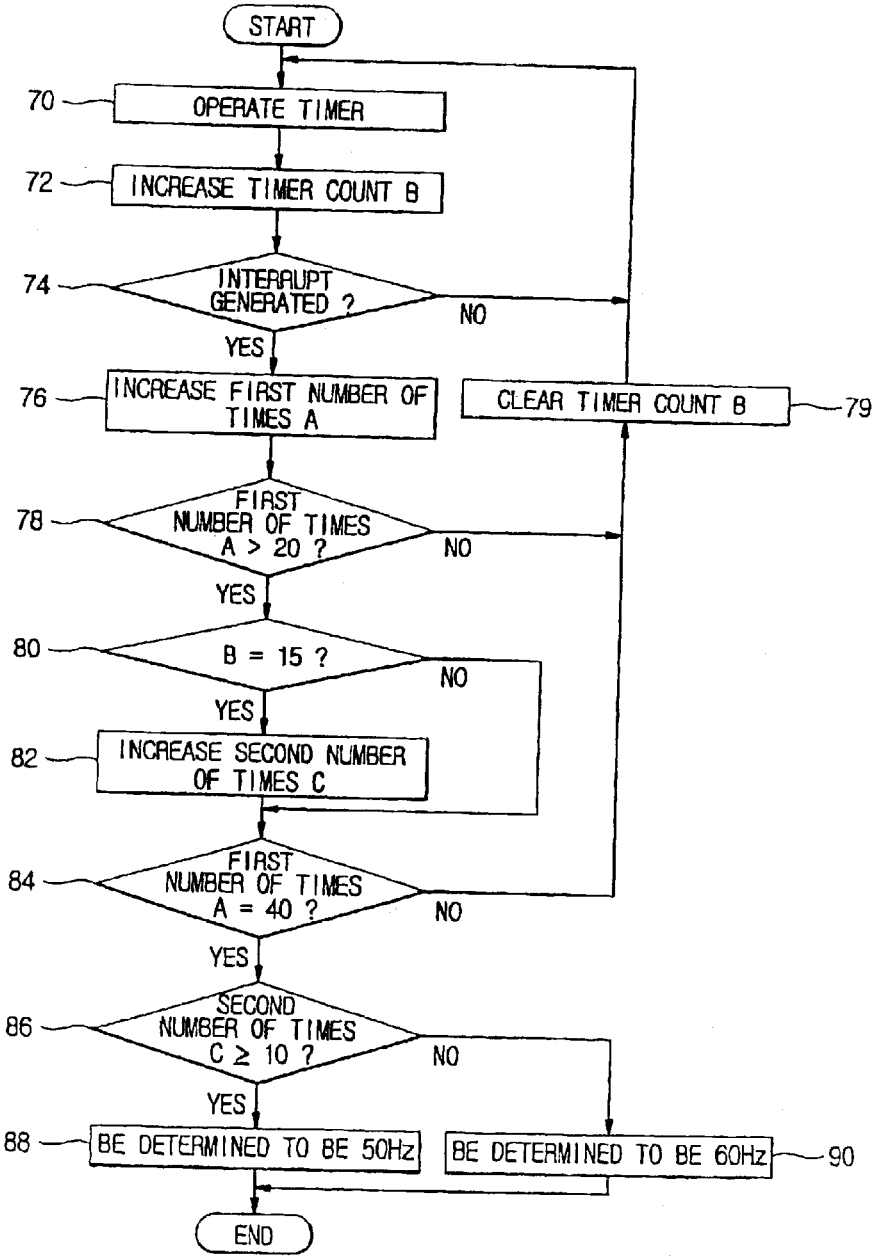
FIG. 2 (PRIOR ART)
FIG. 2 is a flowchart illustrating a conventional method of controlling the microwave oven of FIG. 1.
Figure 3:
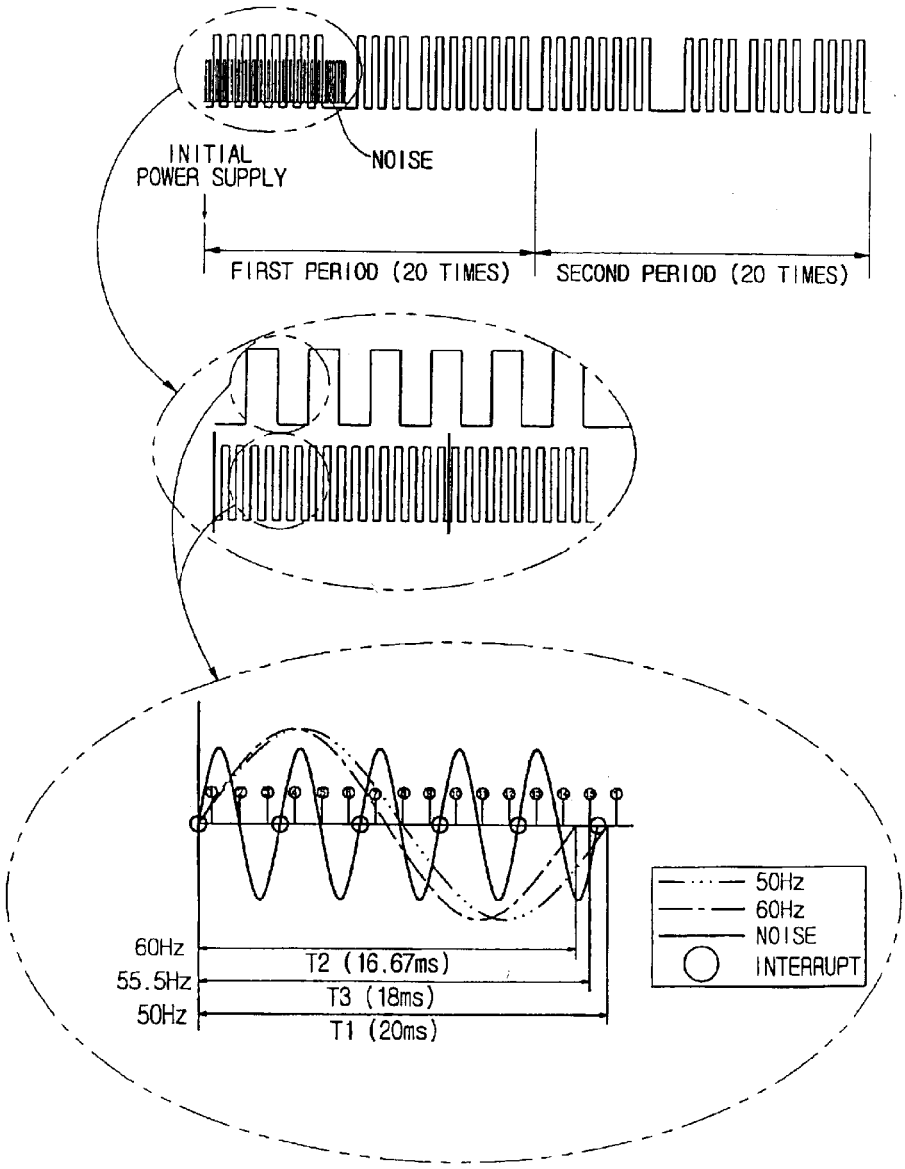
FIG. 3 (PRIOR ART)
FIG. 3 is a schematic view illustrating that the power supply frequency is incorrectly measured due to high frequency noise in the conventional microwave oven of FIG. 1.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Figure 4:
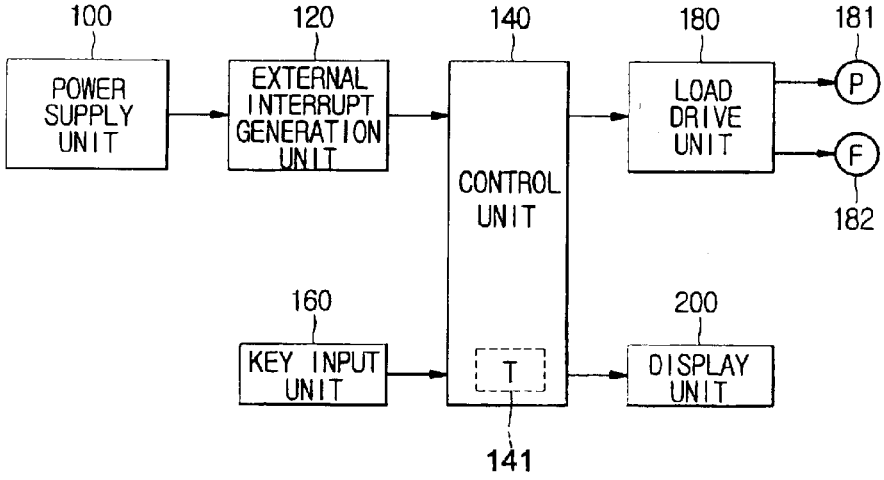
FIG. 4 is a block diagram of a microwave oven according to an embodiment of the present invention.

FIG. 4 is a block diagram of a microwave oven according to an embodiment of the present invention, wherein the microwave oven includes a power supply unit 100, an external interrupt generation unit 120, and a control unit 140. The power supply unit 100 serves to lower an Alternating Current (AC) source voltage of 220 V to an AC source voltage of 17 V and to output the lower source voltage. The external interrupt generation unit 120 generates external interrupts corresponding to a power supply frequency of the AC source voltage lowered by the power supply unit 100. The control unit 140 calculates a cooking time using the power supply frequency by recognizing the power supply frequency on a basis of the external interrupts inputted from the external interrupt generation unit 120 and controls the overall operation of the microwave oven, including causing a cooking unit (not shown) to supply microwaves for use in cooking items disposed in the microwave oven. The control unit 140 is equipped with an inner timer 141.

The control unit 140 is connected at its input terminal to a key input unit 160 that is equipped with function keys that set cooking conditions and that outputs a key signal in response to manipulation of a corresponding function key. The control unit 140 is connected at an output terminal to a load drive unit 180 that drives a power relay P 181 and a cooling fan F 182 in accordance with a set of cooking conditions, and a display unit 200 that displays the set of cooking conditions, cooking status and the like.

The control unit 140 controls an operation status of the external interrupts to eliminate undesirable influences of high frequency noise at the time of initial power supply. That is, the control unit 140 disables the external interrupts before a timer count B reaches a predetermined set value, while the control unit 140 enables the external interrupts after the timer count B reaches the predetermined set value.

Figure 5:
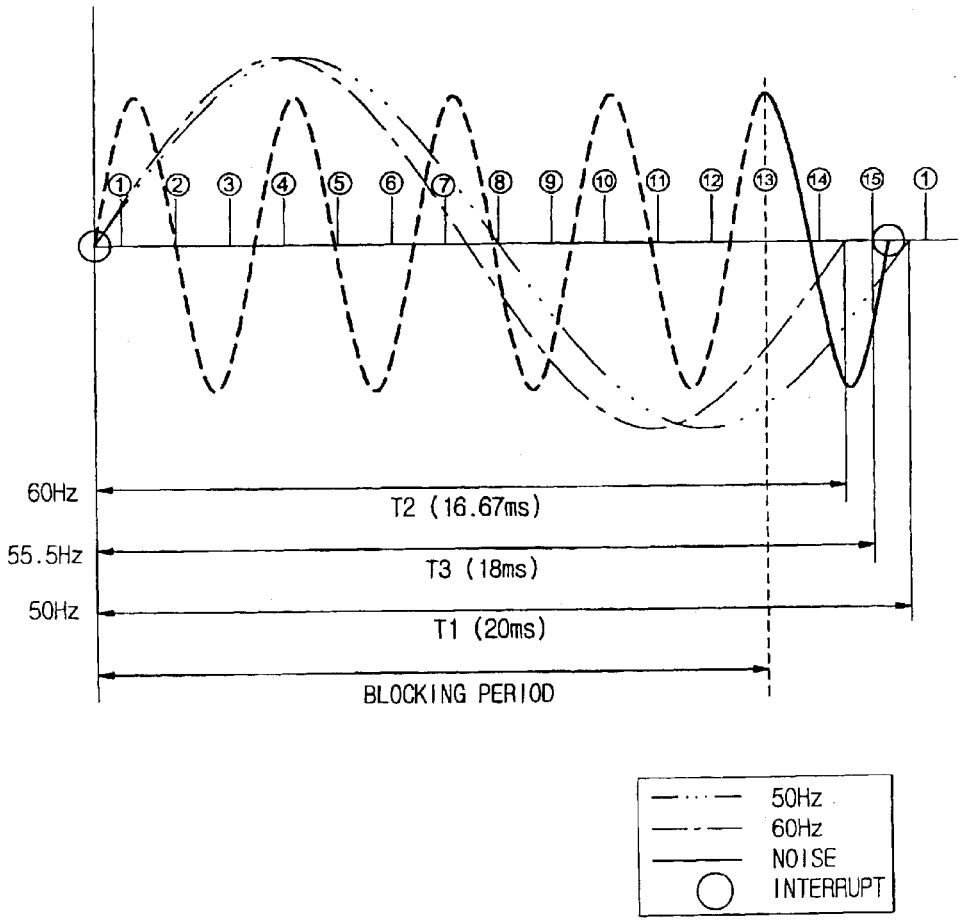
FIG. 5 is a schematic view illustrating the operation of measuring the power supply frequency of the microwave oven of FIG. 4.

Referring to FIG. 5, the timer count B measured by the inner timer 141 for each cycle of a power supply signal is different according to the power supply frequency of the power supply signal. For example, if the power supply frequency is 50 Hz, the measured timer count B is fifteen. In contrast, if the power supply frequency is 60 Hz, the measured timer count B is fourteen. Accordingly, the power supply frequencies may be discriminated from each other by the timer count B. Thus, if the timer count B exceeds thirteen, the power supply frequency is either 50 Hz or 60 Hz.

$T_p$ is a blocking period, i.e., a period for which the measurement of the power supply frequency is deferred. In the present invention, the external interrupts are disabled, that is, after an external interrupt has been generated, the blocking period $T_p$ is set to block the generation of the external interrupts until the accumulatively increased timer count B reaches thirteen. Thereafter, if the blocking period $T_p$ elapses, that is, if the timer count B exceeds thirteen, the external interrupts are enabled so that next external interrupts are generated. If the blocking period $T_p$ is set as described above, false external interrupts caused by high frequency noise may essentially be prevented from being generated. By setting the blocking period $T_p$ the first period for which the measurement of the power supply frequency is deferred is prevented from being shortened due to high frequency noise. Accordingly, the power supply frequency may be measured in a state of stable power, so the power supply frequency may be correctly recognized.

Figure 6:
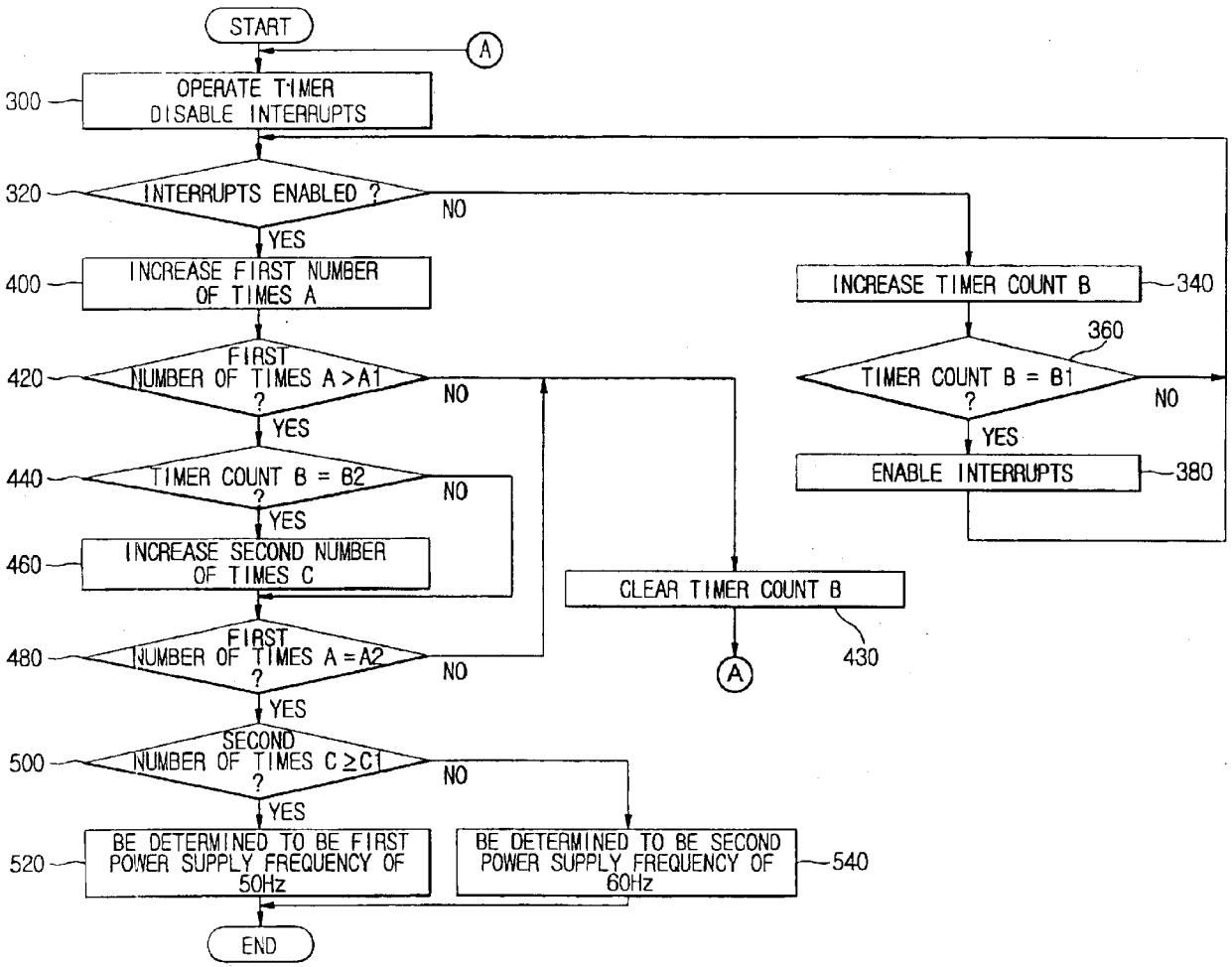
FIG. 6 is a flowchart illustrating a method of controlling the microwave oven of FIG. 4.

Hereinafter, there is described a method of controlling the microwave oven of the present invention with reference to FIG. 6. If power is supplied to the microwave oven, the control unit 140 drives the inner timer 141 and inactivates external power supply interrupts (hereinafter, referred to as just "interrupts"; which are compared to internal interrupts by the inner timer). That is, the control unit 140 disables the interrupts at operation 300.

Thereafter, the control unit 140 determines whether the interrupts are activated, that is, the interrupts are enabled, at operation 320. If the interrupts are disabled, the timer count B is increased cumulatively at operation 340. In this case, the timer count B is increased cumulatively if the internal interrupts are generated at certain intervals in the inner timer 141. Thereafter, it is determined if the timer count B has attained a predetermined set value B1 at operation 360. If the timer count B is equal to the predetermined set value B1, the predetermined set value B1 is used to set the blocking period $T_p$. In one embodiment, the blocking period $T_p$ is set to thirteen.

If the accumulated timer count B is less than the predetermined set value B1, the process proceeds to operation 320. In contrast, if the accumulated timer count B is equal to the predetermined set value B1, that is, the blocking period $T_p$ has elapsed, the interrupts are enabled, and then the process proceeds to operation 320.

If the interrupts are enabled at operation 320, the first number of times A the interrupts are generated is increased cumulatively at operation 400. Thereafter, it is determined if the first number of times A exceeds a predetermined set value A1 at operation 420. If the first number of times A is greater than the predetermined set value A1, the predetermined set value Al is set to defer the measurement of the power supply frequency. In one embodiment, the predetermined set value A1 is set to twenty. If the first number of times A is less than or equal to the predetermined set value A1, the process proceeds to operation 430 where the timer count is cleared, and then proceeds to operation 300.

If the first number of times A exceeds the set value A1, it is determined if the timer count B equals a predetermined set value B2 at operation 440. If the timer count B equals a predetermined set value B2, the predetermined set value B2 is set to discriminate between a first power supply frequency of 50 Hz and a second power supply frequency of 60 Hz. In one embodiment, the predetermined set value B2 is set to fifteen. If the timer count B equals the predetermined set value B2, a second number of times C is cumulatively increased at operation 460. Thereafter, it is determined whether the first number of times A equals a predetermined set value A2 at operation 480. In one embodiment, the predetermined set value A2 is set to forty. In contrast, if the timer count B is less than the set value B2, the process proceeds to operation 480.

As the result of the determination at operation 480, if the first number of times A is greater than or equal to the predetermined set value A2, that is, if all the blocking periods $T_p$ elapse, it is determined whether the second number of times C is equal to or larger than a predetermined set value C1 at operation 500. In one embodiment, the predetermined set value C1 is set to ten. If the second number of times C is equal to or larger than the predetermined set value C1, the power supply frequency is determined to be a first frequency of 50 Hz at operation 520. In contrast, if the second number of times C is smaller than the predetermined set value C1, the power supply frequency is determined to be a second frequency of 60 Hz at operation 540.

As described above in detail, the microwave oven and the method of controlling the microwave oven defer generation of the interrupts during the blocking period set until the timer count measured by the inner timer reaches the predetermined set value and allow the generation of the interrupts if the blocking period elapses. Accordingly, the microwave oven and the method of the controlling the microwave oven of the present invention provide the capability of correctly recognizing the power supply frequency without the influence of noise at the time power is supplied, thereby improving the reliability of the microwave oven.

In one embodiment, present invention may be implemented by utilizing a computer-readable medium having instructions stored thereon for causing a computer/control unit to perform a method of controlling the microwave oven in accordance with the present invention.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A microwave oven, comprising:

a power supply unit;

a cooking unit supplying microwaves for use in cooking items disposed in the microwave oven;

an interrupt generation unit generating interrupts, corresponding to a power supply frequency of the power supply unit; and a control unit setting a blocking period to block generation of the interrupts, recognizing a power supply frequency on a basis of the interrupts generated by the interrupt generation unit when the blocking period elapses, and controlling the cooking unit to cook the items disposed in the microwave oven, wherein said blocking period blocks generation of interrupts caused by high frequency noise.

2. The microwave oven as set forth in claim 1, wherein said blocking period is set at an initial stage of a power supply to the power supply unit.

3. The microwave oven as set forth in claim 1, wherein said control unit is equipped with an inner timer, determines that the blocking period has elapsed if a timer count of the inner timer reaches a predetermined set value, and determines that the blocking period is not elapsed if the timer count of the inner timer is less than the predetermined set value.

4. The microwave oven as set forth in claim 1, wherein said control unit sets the blocking period to be at least one cycle shorter than one period of a power supply signal having the power supply frequency to be recognized.

5. The microwave oven as set forth in claim 1, wherein said power supply frequency is one of 50 Hz or 60 Hz.

6. A method of controlling a microwave oven, the microwave oven setting a power supply frequency at a time power is supplied, comprising:

setting a blocking period to block generation of interrupts by the power supply frequency, wherein said blocking period blocks generation of interrupts caused by high frequency noise;

increasing a timer count using an inner timer;

determining whether the blocking period has elapsed by comparing the timer count with a predetermined set value;

generating interrupts corresponding to the power supply frequency if the blocking period has elapsed; and determining the power supply frequency in accordance with the interrupts generated.

7. The method as set forth in claim 6, wherein said blocking period is set at an initial stage of the supply of power.

8. A method of controlling a microwave oven, the microwave oven setting a power supply frequency at a time power is supplied, comprising:

setting a first period for which measurement of the power supply frequency is deferred and a second period for which the measurement of the power supply frequency is carried out;

setting a blocking period in which generation of interrupts is blocked for each cycle of a power supply signal in accordance with the power supply frequency in one of the first period or the second period of the power supply signal, wherein said blocking period blocks generation of interrupts caused by high frequency noise; and cooking using the power supply frequency set using the measurement.

9. The method as set forth in claim 8, wherein said blocking period is set at an initial stage of the power being supplied.

10. A computer-readable medium having instructions stored thereon for causing a computer/control unit to perform a method of controlling a microwave oven, comprising:

utilizing, upon connection to a power supply, an interrupt generation unit to generate interrupts corresponding to a power supply frequency of the power supply unit; and utilizing a control unit to set up a blocking period to block generation of the interrupts, to recognize a power supply frequency on a basis of the interrupts when the blocking period elapses, wherein said blocking period blocks generation of interrupts caused by high frequency noise, and controlling a cooking unit supply microwaves to cook items disposed in the microwave oven using the recognized power supply frequency.

11. A computer-readable medium having stored thereon computer-executable instructions for performing the method of claim 8.

12. A computer-readable medium stored thereon computer-executable instructions for performing the method of claim 6.

13. A microwave oven comprising:

a blocking period-based control unit setting a power supply frequency at a time power is supplied by setting a first period for which measurement of the power supply frequency is deferred and a second period for which the measurement of the power supply frequency is carried out, and generating blocking period blocks of interrupts caused by high frequency noise; and a cooking unit to cook using the power supply frequency set using the measurement.

14. The microwave oven as set forth in claim 13, wherein measurement of the power supply frequency is deferred by generating a blocking period in which generation of interrupts is blocked for each cycle of a power supply signal in accordance with the power supply frequency in one of the first period or the second period of the power supply signal.

15. The microwave oven as set forth in claim 14, wherein said blocking period blocks generation of the interrupts caused by high frequency noise.

16. The microwave oven as set forth in claim 15, including a power supply unit, wherein said blocking period is set at an initial stage of a power supply to the power supply unit.

17. The microwave oven as set forth in claim 14, wherein said control unit is equipped with an inner timer, determines that the blocking period has elapsed if a timer count of the inner timer reaches a predetermined set value, and determines that the blocking period is not elated if the timer count of the inner timer is less than the predetermined set value.

18. The microwave oven as set forth in claim 14, wherein said control unit sets the blocking period to be at least one cycle shorter than one period of a power supply signal with the power supply frequency set using the measurement.

19. The microwave oven as set forth in claim 13, wherein said power supply frequency is one of 50 Hz or 60 Hz.

20. A microwave oven comprising:

a high-frequency noise-eliminating control unit that generates blocking period blocks to disable extraneous interrupts caused by high frequency noise to select a power supply frequency when power is supplied; and a cooking unit to cook using the power supply frequency selected.

21. The oven as set in claim 20, wherein the high-frequency noise-eliminating control unit selects a blocking period to block generation of the extraneous interrupts caused by high frequency noise.

22. The microwave oven as set forth in claim 21, including a power supply unit, wherein the high-frequency noise-eliminating control unit sets the blocking period at an initial stage of a power supply to the power supply unit.

23. The microwave oven as set forth in claim 20, wherein the high-frequency noise-eliminating control unit is equipped with an inner timer, determines that the blocking period has elapsed if a timer count of the inner timer reaches a predetermined set value, and determines that the blocking period is not elapsed if the timer count of the inner timer is less than the predetermined set value.

24. The microwave oven as set forth in claim 20, wherein the high-frequency noise-eliminating control unit sets the blocking period to be at least one cycle shorter than one period of a power supply signal with the power supply frequency selected.

25. The microwave oven as set forth in claim 20, wherein said power supply frequency is one of 50 Hz or 60 Hz.

* * * * *

UNITED STATES PATENT AND TRADEMARK OFFICE

CERTIFICATE OF CORRECTION

PATENT NO. : 6,855,918 B2
DATED : February 15, 2005
INVENTOR(S) : Joo-Hyun Do

It is certified that error appears in the above-identified patent and that said Letters Patent is hereby corrected as shown below:

Column 7,
Line 31, after "medium" insert -- having --.

Column 8,
Line 11, change "elated" to -- elapsed --; and
Line 26, after the first occurrence of "the" insert -- microwave --.

Signed and Sealed this

Twenty-ninth Day of November, 2005

JON W. DUDAS
*Director of the United States Patent and Trademark Office*